US006929131B1

(12) United States Patent
Landi

(10) Patent No.: US 6,929,131 B1
(45) Date of Patent: Aug. 16, 2005

(54) DISPLAY SYSTEM

(75) Inventor: Arthur E. Landi, Greenwich, CT (US)

(73) Assignee: Display Producers Inc., Bronx, NY (US)

( * ) Notice: Subject to any disclaimer, the term of this patent is extended or adjusted under 35 U.S.C. 154(b) by 0 days.

(21) Appl. No.: 10/283,469

(22) Filed: Oct. 30, 2002

(51) Int. Cl.[7] ..... A47F 5/00

(52) U.S. Cl. ..... 211/87.01; 211/94.01; 248/222.51; 248/223.41; 248/225.11

(58) Field of Search ..... 211/94.01, 87.01, 211/57.1, 59.1, 106; 248/222.51, 223.41, 248/225.11

(56) References Cited

U.S. PATENT DOCUMENTS 4,352,478 A * 10/1982 Loew ..... 248/222.11
4,461,443 A * 7/1984 Dauman ..... 248/220.41
4,509,648 A * 4/1985 Govang et al. ..... 211/70.6
4,989,815 A * 2/1991 McAuley ..... 248/224.61
5,154,304 A * 10/1992 McAuley ..... 211/59.1
5,228,579 A * 7/1993 Kaufman ..... 211/94.01
5,775,521 A * 7/1998 Tisbo ..... 211/94.01
5,944,203 A * 8/1999 Vlah et al. ..... 211/189
5,983,574 A * 11/1999 Holztrager ..... 52/36.5
6,116,435 A * 9/2000 Young ..... 211/94.01
6,164,467 A * 12/2000 DePottey et al. ..... 211/189
6,325,223 B1 * 12/2001 Hannen ..... 211/87.01
6,491,172 B2 * 12/2002 Chance et al. ..... 211/87.01

* cited by examiner

*Primary Examiner*—Robert W. Gibson, Jr.
(74) *Attorney, Agent, or Firm*—Schweitzer Cornman Gross & Bondell LLP

(57) ABSTRACT

An improved display system particularly adapted for the display of consumer products in a retail sales environment includes a backboard and fixtures mountable thereon. Individual backboard panels may be interconnected. The backboard panels are of a horizontally slotted construction. While the fixtures are provided with an interlock structure that allows them to be installed on the panels in a rigid manner. By use of an adapter, the backboards may be retrofitted upon a conventional pegboard or slotwall. A second adapter allows the fixtures to be used in connection with a pegboard or slotwall.

13 Claims, 18 Drawing Sheets

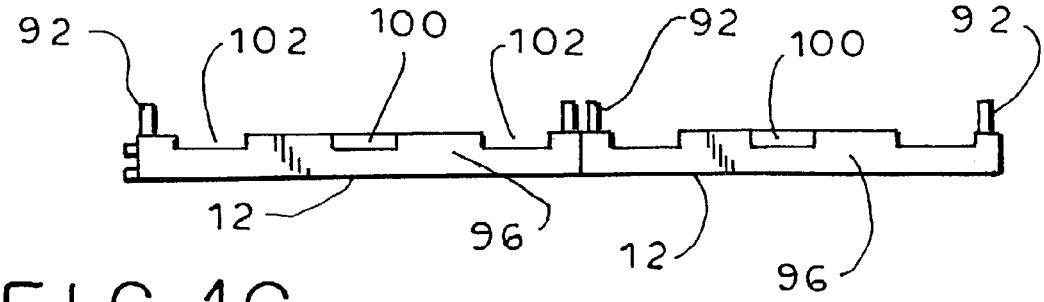
FIG.1C
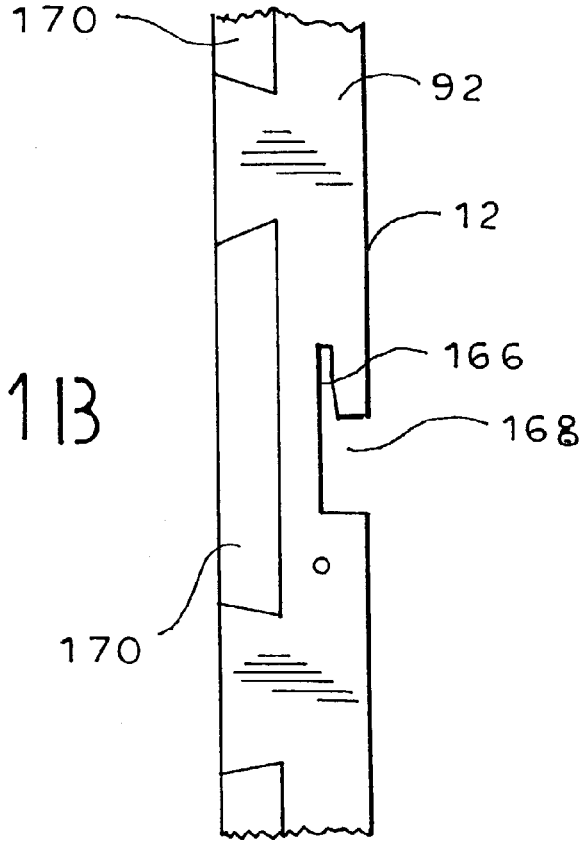
FIG.1B
FIG.1D
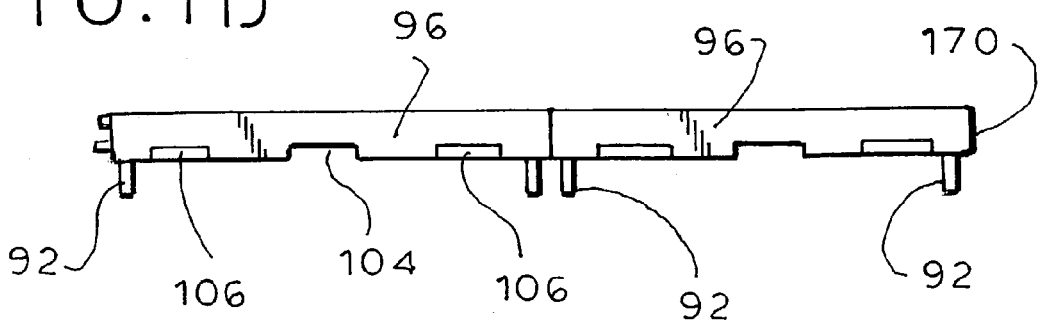

DISPLAY SYSTEM

The present invention relates to a new and improved display system particularly adapted for the presentation and display of items for sale in a retail environment.

BACKGROUND OF THE INVENTION

The presentation of products for consumer purchase, particularly in a retail environment, has long been the focus of attention. With the ever-increasing number and variety of products offered, both manufacturers and retailers strive to both present their products in an attractive manner while at the same time best utilizing the fixed amount of space available. A conventional apparatus for the display of products is a peg board system, in which vertically-extending panels of peg board, typically having a matrix of holes arrayed thereacross, are mounted to walls, partitions, or other vertical structures. A variety of fixtures have been developed to be mounted to the peg boards, the fixtures in turn being adapted to display a wide variety of products in a variety of manners. Such fixtures include simple hook and brackets, as well as shelves, bins and other constructions particularly adapted for the presentation of particular products.

While ubiquitous, peg board display systems suffer from several disadvantages. The peg board sheets themselves, typically formed of a pressboard or similar material, can be subject to warpage. This can make it difficult to mount large size fixtures thereon. In addition, adjacent sheets often are not precisely aligned with each other, thus limiting the ability of the associated fixtures to span the seam between fixtures, as the mounting holes often do not align sufficiently precisely to accept the fixturing. In addition, the adjacent edges of panels are often provided with filler or molding strips, which themselves stand outwardly from the plane of the panels and prevent the bridging of panels by fixtures. Further, the nature of peg board constructions require a pivoting action of a fixture for fixture insertion or removal. This makes the replacement of a particular fixture in a completed display more difficult, often necessitating the complete removal of a display array to allow repositioning of an individual fixture unit. Similar problems and constraints exist with respect to other known display systems, such as slot wall and uni-wall based systems.

It is accordingly a purpose of the present invention to provide a fixture system which avoids the disadvantages of prior art peg board and slot wall-based units.

It is a further purpose of the present invention to provide a fixturing system which includes both a mounting or backboard and individual fixturing elements which can be utilized together to provide a display system of increased strength and rigidity, as well as flexibility.

It is a further purpose of the present invention to provide such a fixturing system in which the individual fixtures, by use of appropriate adapters, can be used with conventional prior art-type systems.

Yet a further purpose of the present invention is to provide a backboard system of improved rigidity and flatness, and a system in which the backboards can be mounted in an overlying manner to a pegboard, slotwall, or uniweb wall surface, as well as directly upon a wall.

Still another purpose of the present invention is to provide a fixturing system that offers increased efficiency of installation and shipping/storage of its components.

BRIEF DESCRIPTION OF THE INVENTION

The present invention provides a precisely aligned and rigid wall panel arrangement in which individual backboard panels can be interconnected, both vertically and horizontally, without use of additional connectors or brackets, and a series of fixtures mountable thereon in a rigid, but easily insertable and removable, manner.

In accordance with the foregoing and other objects, benefits and features, a display fixturing system of the present invention includes a backboard structure and a fixture construction. The backboard structure is of a flat grid format, having a horizontal series of spaced acceptance slots adapted to receive rearwardly-extending projections on the fixtures, and includes both spaced horizontal slats forming a fixture-accepting face and rearwardly-extending horizontal elements providing a rigid structure. Integral mounting means allow the horizontal and vertical interconnection of adjacent panels to form an integrated wall of flexible extended height and width.

The fixture elements 36 include a wedge locking system which substantially eliminate the vertical displacement required for mounting and removal of prior art fixtures, avoids the need to remove fixtures to install or remove a fixture unit, thus providing a substantial saving in assembly/disassembly time and which provides a locking feature for the fixture. A mounting bracket includes engagement means that extend through acceptance slots of the backboard. The wedge system also engages at least one of the slots, along with the engagement means, providing a wedging or locking action between the engagement means and the backboard, retaining the mounting bracket and fixture in place and preventing inadvertent disengagement and removal.

In a first embodiment of a fixture according to the invention, a sliding tray base supported upon the mounting bracket includes the wedge system, and provides the locking or wedging action within the backboard slots when the tray base in a rearward position. The tray base may hold products directly, or serve as a receptacle for inserts, dividers, and the like which in turn accept and display product.

In a second embodiment of the fixture, the wedge system is fixed in place on the mounting bracket, and engages the mounting board slots through a camming action when the fixture in mounted.

The locking structure, while particularly well adapted for use in conjunction with the backboard structure of the present invention, allows the fixturing, which may be manufacturing in a variety of shapes and configurations, to be utilized with other slot wall structures as well.

The backboard structure may be incorporated into an adapter that is mounted upon a pegboard or slot wall to allow an individual fixture of the invention to be installed thereon. The adapter includes hangers extending rearwardly from the bracket engage the pegboard or slotwall/uniwall, as well as at least one horizontal slot adapted to accept the shelf mount.

BRIEF DESCRIPTION OF THE DRAWINGS

A fuller understanding of the invention will be achieved upon consideration of the following detailed, but nonetheless illustrative description thereof, when reviewed in association with the annexed drawings, wherein:

FIG. 1B is a side elevation view of a portion of a backboard taken from the direction 1B—1B of FIG. 1A;

FIG. 1C is a top plan view of the backboard array taken from the direction 1C—1C of FIG. 1A;

FIG. 1D is a bottom plan view of the backboard array taken from the direction 1D—1D of FIG. 1A;

DETAILED DESCRIPTION OF THE INVENTION

Figure 1A:
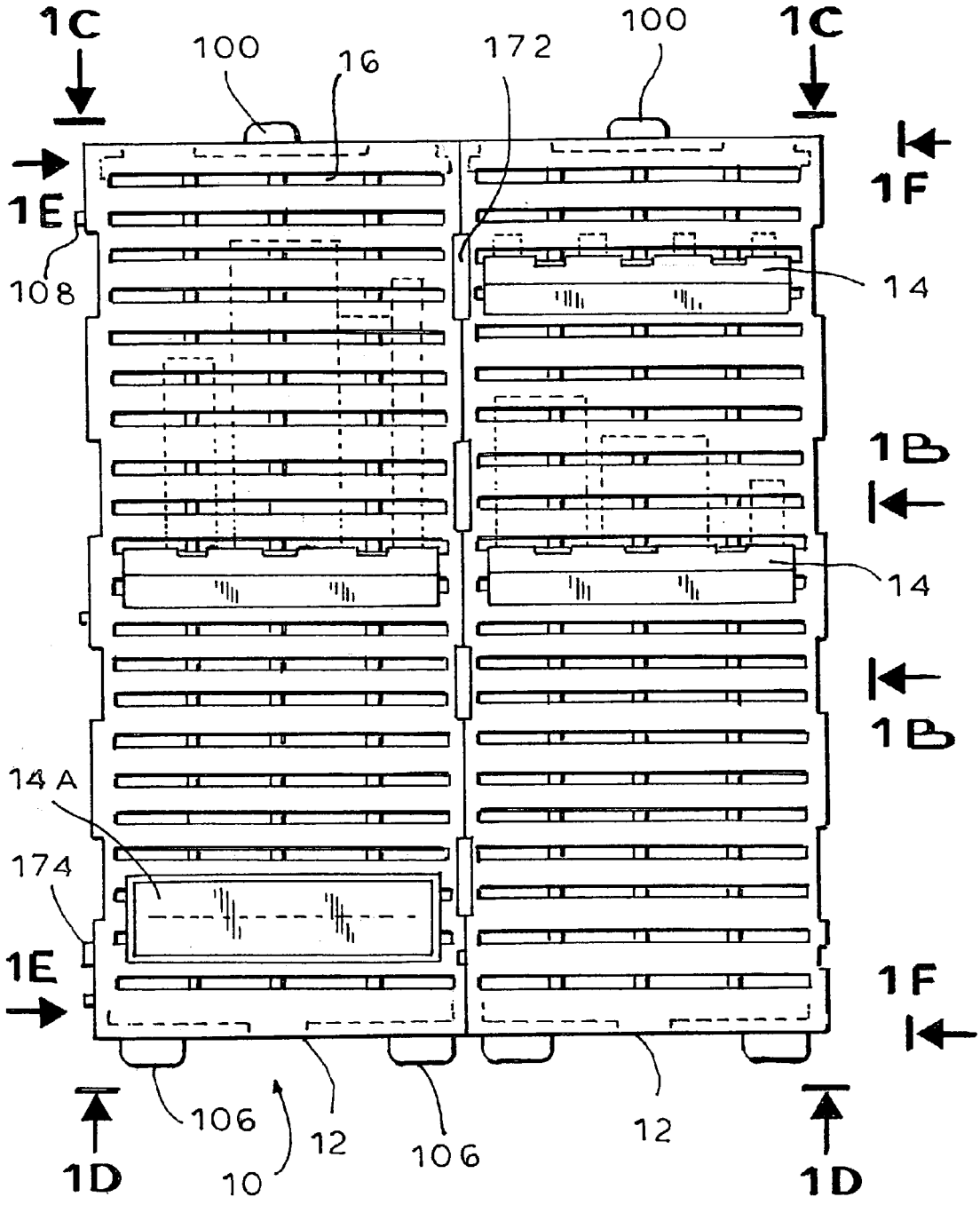
FIG. 1A is a front elevation view of a fixture of the invention mounted on an interconnected array of backboards thereof.
Figure 1E:
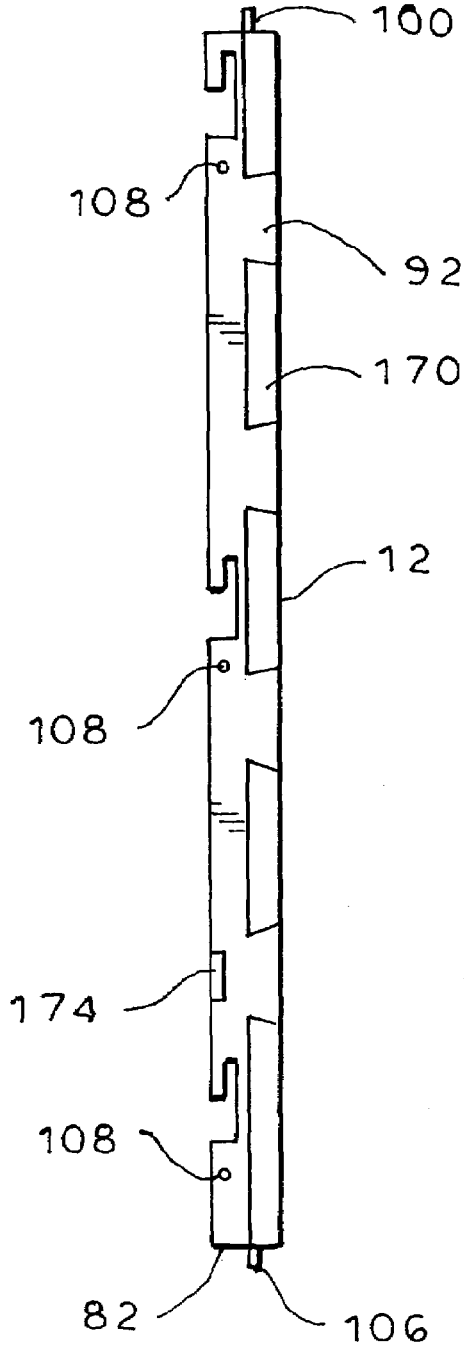
FIG. 1E is a first side view of a backboard.
Figure 1F:
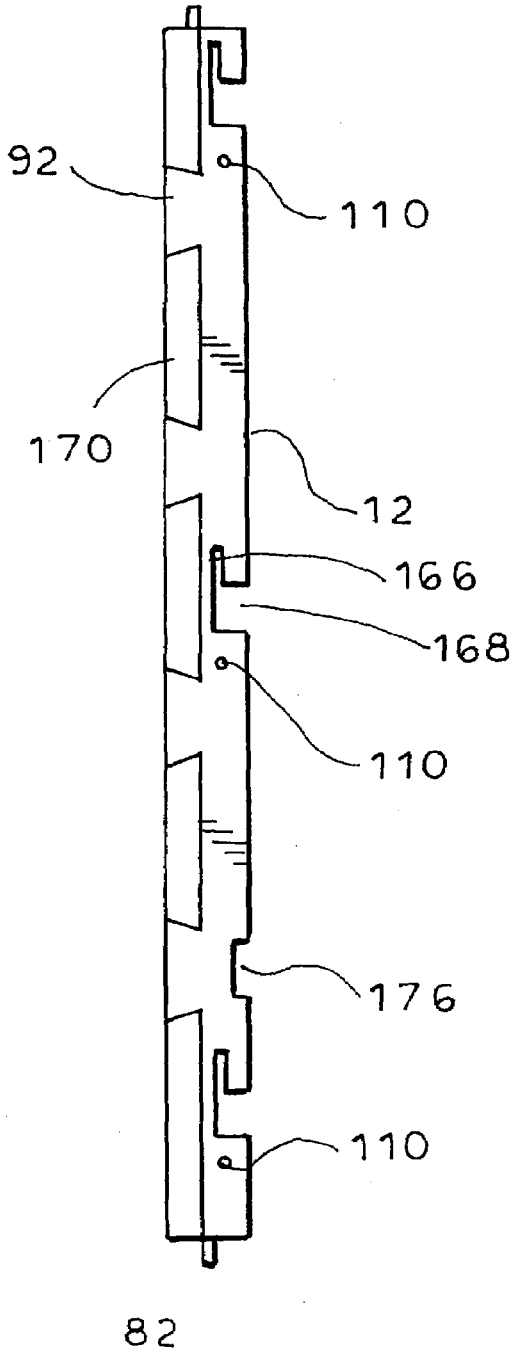
FIG. 1F is a second side view of a backboard.
Figure 2A:
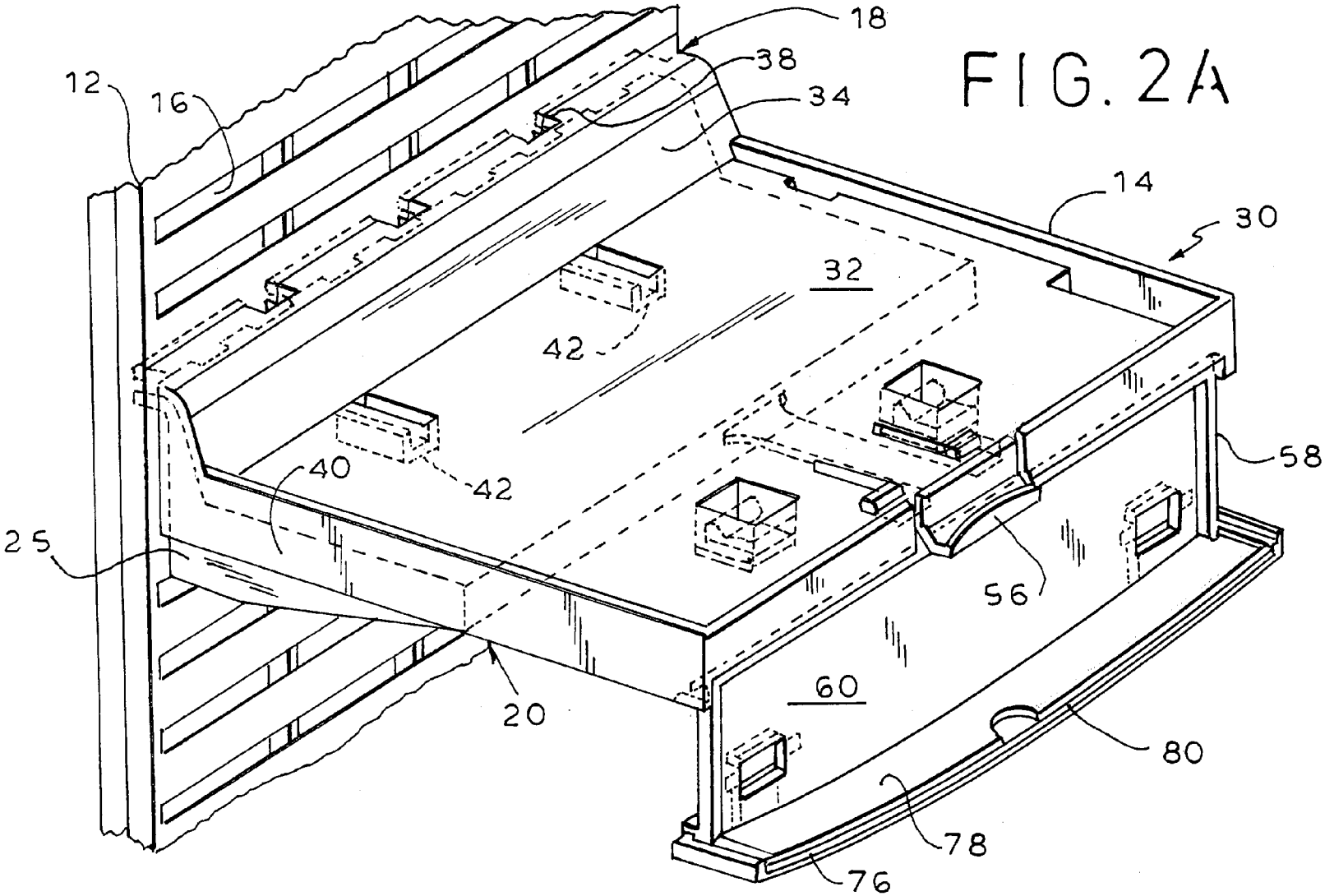
FIG. 2A is a perspective view of a fixture of the invention mounted on a backboard.
Figure 2B:
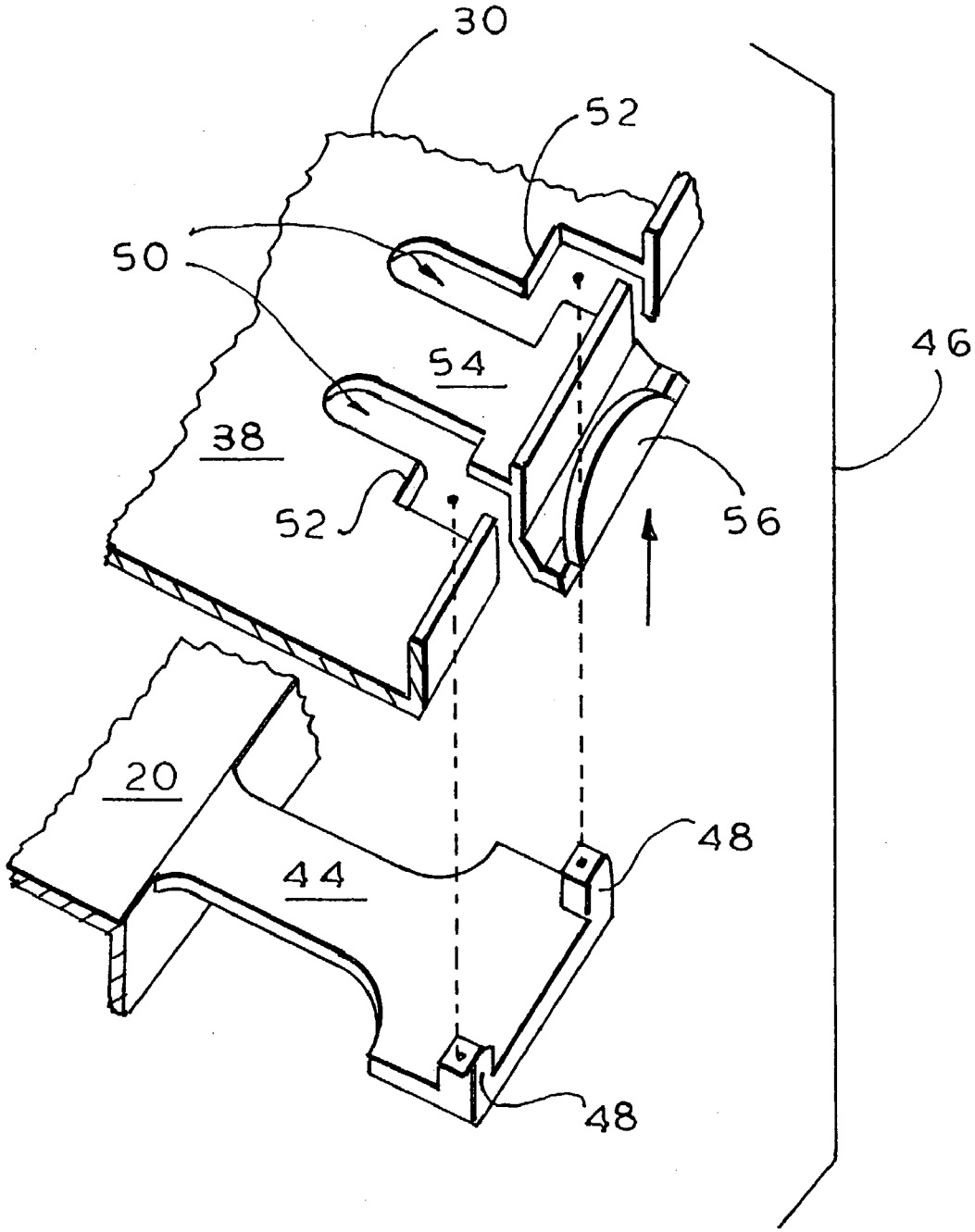
FIG. 2B is an exploded view of a portion of FIG. 2A detailing a lock mechanism.
Figure 3:
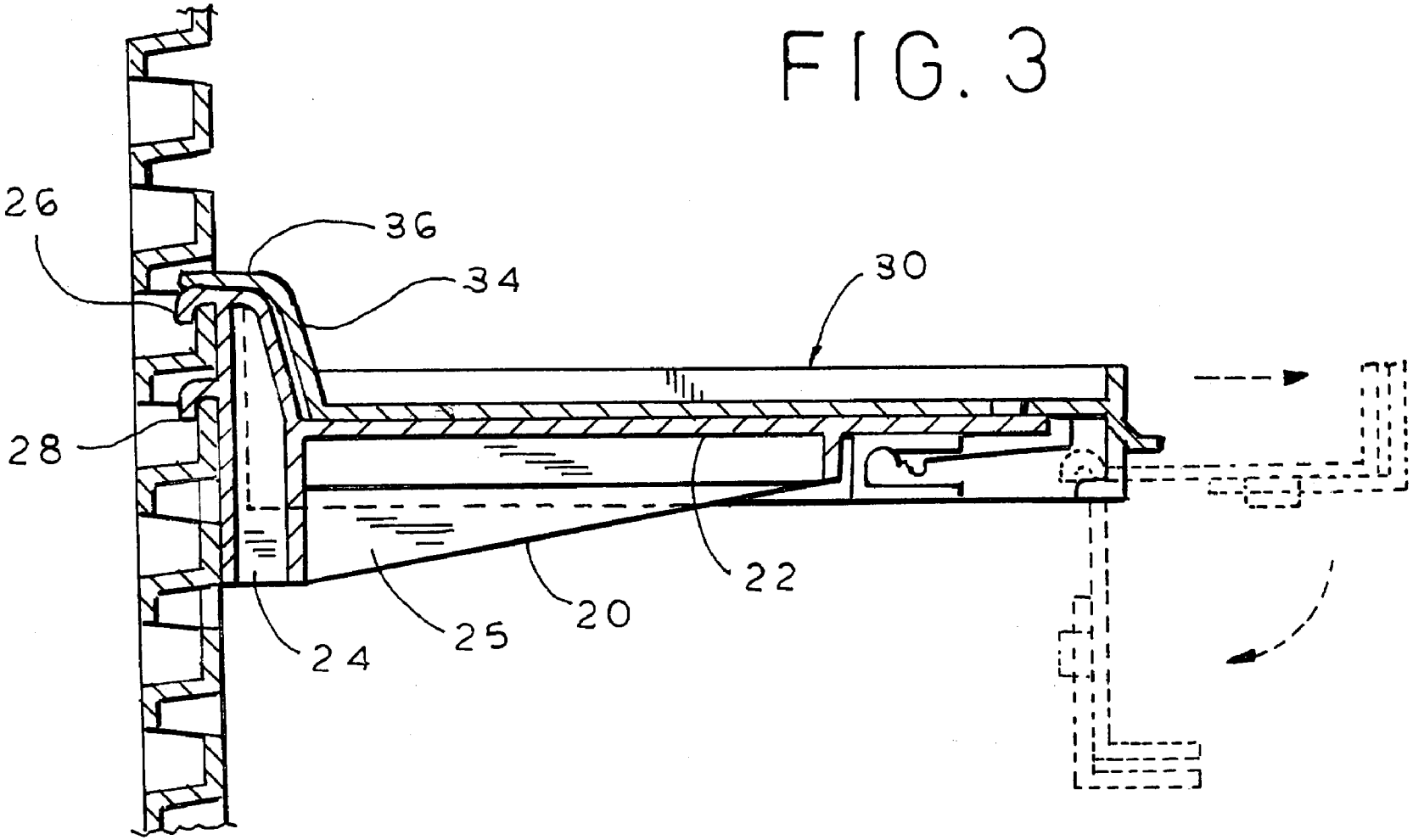
FIG. 3 is a sectional view taken along line 3—3 of FIG. 2A depicting a front price rail of the fixture in extended and lowered positions.

With initial reference to FIGS. 1 and 2A, the invention 10 includes both one or more vertically-extending mounting backboards 12 and one or more fixtures 14, 14A which may be mounted to the backboards. The backboards are in the form of slotted panel constructions having a series of horizontal acceptance slots 16 into which rearwardly-extending engagement means 18 on the fixtures 14 are inserted. While the fixture 14 is shown as a shelf-like unit capable of supporting a tray or other insert which in turn is utilized for the display of goods, for example cosmetics, being arrayed in tray compartments, it is to be appreciated that the fixture can take any of a number of forms as appropriate for the merchandise to be displayed and the overall configuration and appearance of the fixtures desired, such as a drawer-like fixture 14A. Individual backboards 12 may be mounted in a vertically and horizontally-extending array to allow an extended expanse of wall surface or the like to be covered. The backboards interconnect to form a rigid mounting surface for the fixtures.

Figure 7:
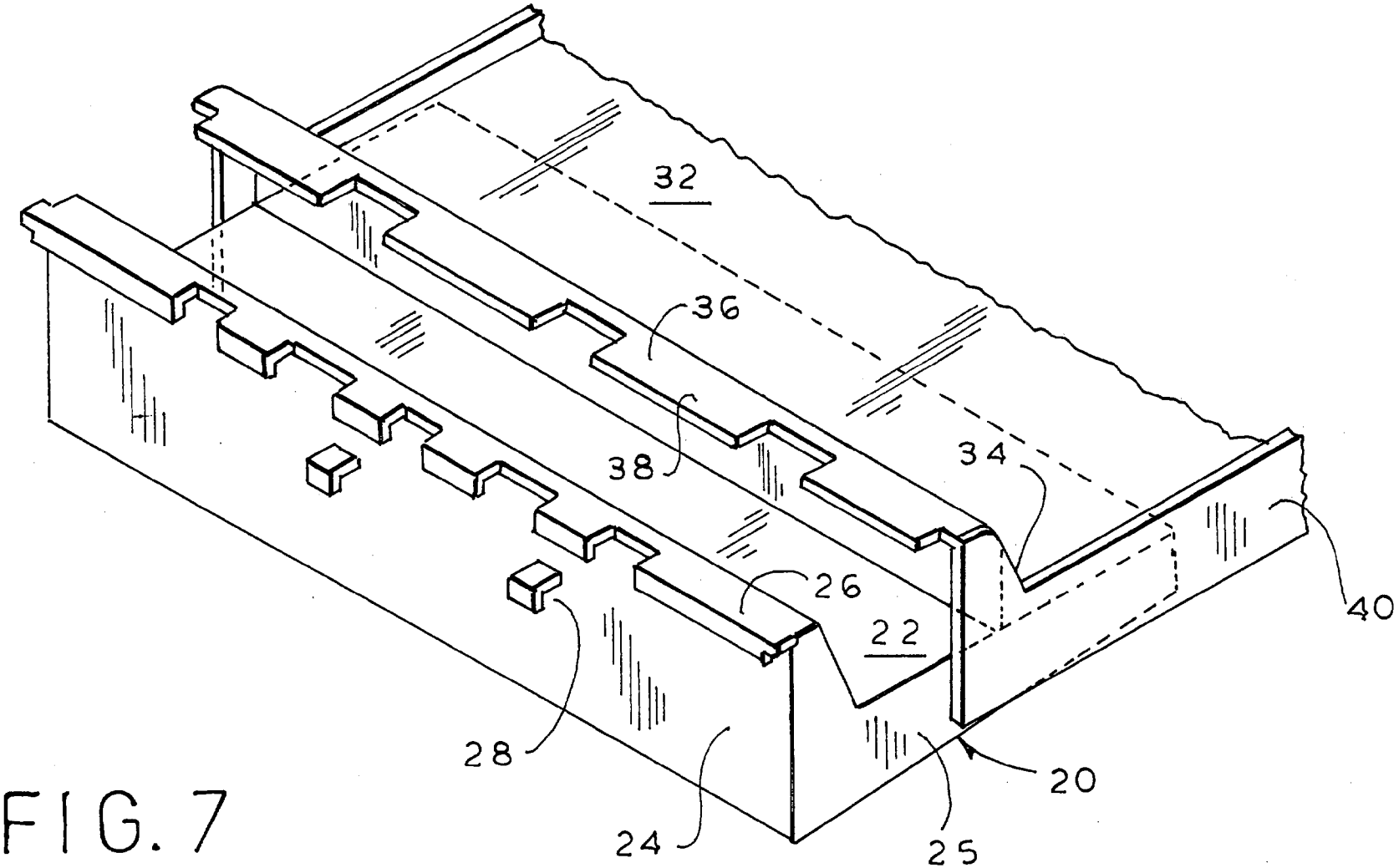
FIG. 7 is a perspective view of the rear portion of the fixture as shown in FIG. 4A.
Figure 8:
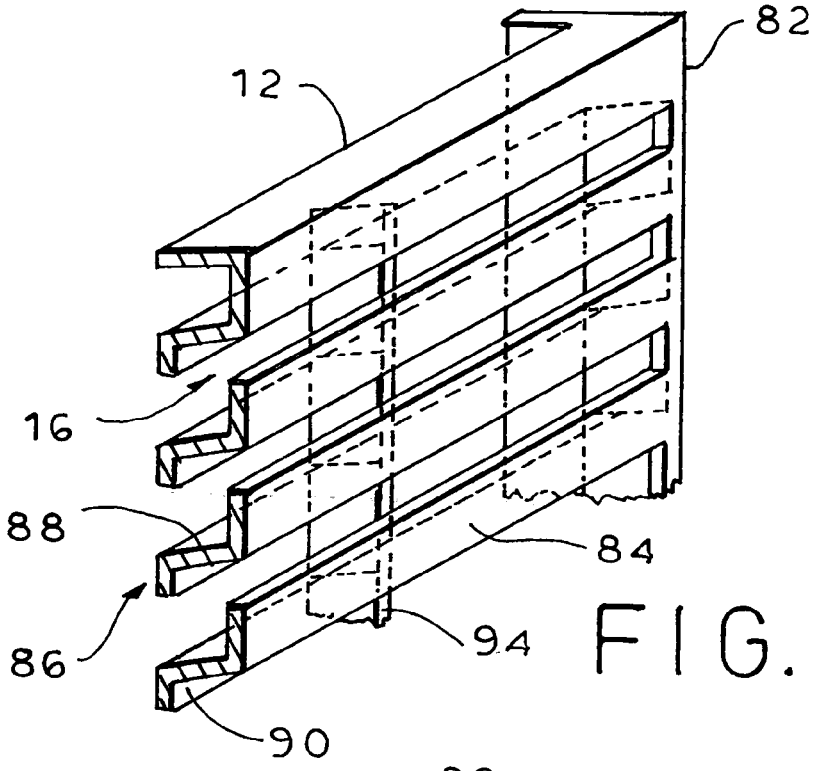
FIG. 8 is a detail front perspective view in section of a portion of a backboard.
Figure 9:
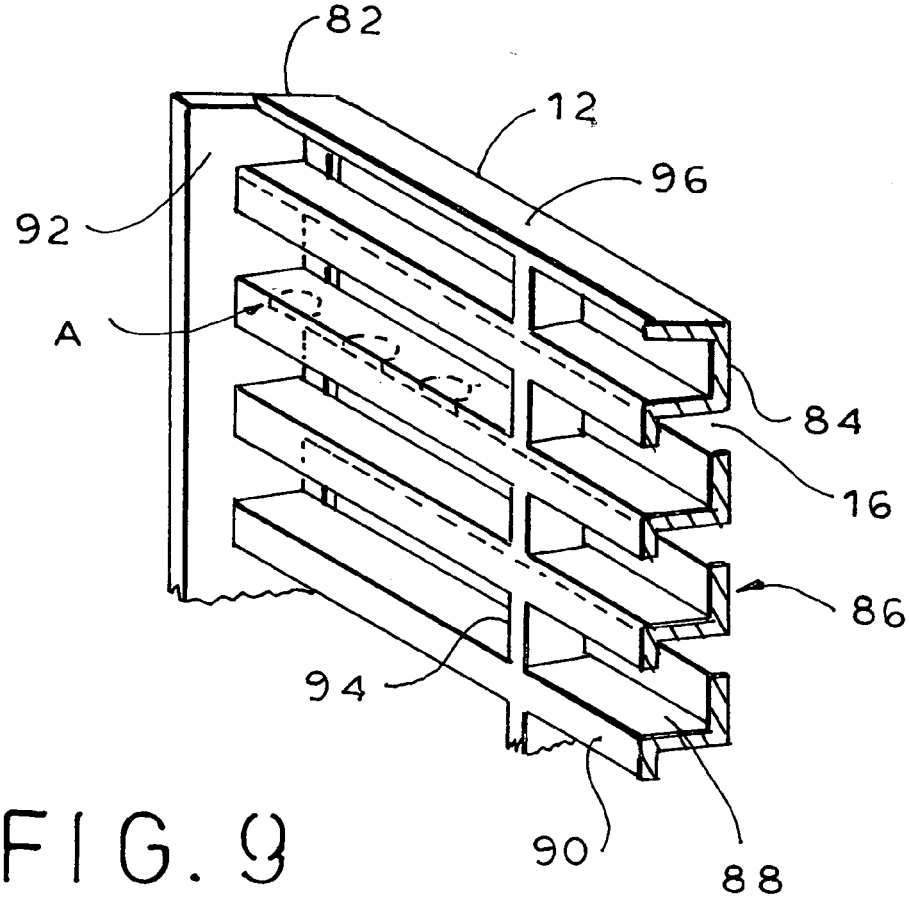
FIG. 9 is a detail rear perspective view in section of a portion of a backboard.

Referring next to FIGS. 2A–7, a fixture 14 comprises a mounting bracket member 20 having a horizontal floor portion 22 and a rear wall 24. (See FIGS. 4A, 4B and 7). Engagement means 18 may comprise upper and lower L-shaped hooks or mounting tabs 26, 28 which extend rearwardly from the rear wall, and are spaced both horizontally and vertically to align with and interfit into two spaced rows of slots 16 on the backboard 12. Preferably, as seen in FIG. 7, the upper hooks 26 may be formed at the top of the rear wall 24, and may comprise a full width series of hook elements, providing the primary support for the fixture on the backboard. The lower hooks 28 may be fewer in number, and may be provided primarily to stabilize the fixture upon the backboard and prevent the fixture from rotating upwardly about the upper hook connection. The bracket member 20 may be molded of any appropriate material, such as plastic, and particularly ABS plastic, to provide toughness and strength. To provide increased rigidity for the member 20, a series of integral flanges or ribs 25 may extend between the rear wall 24 and the lower surface of the floor portion 22. The spacing of both the upper and lower hooks allow the fixture to be oriented horizontally upon a backboard array as desisted, whereby both vertical reinforcement ribs and sidewalls of the backboards can be accommodated and straddled, thus increasing the flexibility of a fixture array.

Sliding tray base 30 is mounted upon the mounting bracket 20, and includes a floor 32 that sits upon the floor of the mounting bracket 20 and a rear wall 34 that terminates at its upper edge in a rearwardly-directed, horizontal wedge ledge 36. The wedge ledge 36 is formed into a series of locking tab portions 38 positioned along the wedge ledge in a manner that allows them to be aligned with the slots 16 on the backboard 12, and particularly with the same slots as those engaged by the upper mounting tabs 26. The tray base 30 may also be provided with side walls 40 which include a depending portion to embrace the sides of the mounting bracket 20, as well as L-shaped flanges 42 depending from the floor 32 that extend through complementary slots in the mounting bracket floor 22 and engage edges of the slots to assist in maintaining tracking of the tray base when it slides forward or back upon the mounting bracket, and to retain the tray base on the mounting bracket. The tray base may be formed of an appropriate plastic, such as styrene. The tray base in turn may support one or more molded inserts (not shown) configured to display product. The inserts may be interchangeable to allow a variety of product types and configurations to be placed on the tray.

With the tray base in a forward position, as shown in FIGS. 4A–7, the fixture 14 may be mounted upon the backboard by simply aligning the hooks 26, 28 with appropriate chosen slots 16 on the backboard and inserting the hooks until the bracket rear wall 24 is flush against the backboard. The fixture is then slightly lowered to engage the hooks with the lower edges of the slots. It is to be appreciated that the height of the backboard slots must of necessity be greater than the overall height of the hooks in order to permit the hooks to be inserted into and removed from the slots. The vertical spacing of the hooks 26, 28 is complementary to the vertical spacing of the slots.

In order to rigidly retain the fixture upon the backboard, and prevent inadvertent removal, the sliding tray base 30 is slid rearwardly until the locking tab portions 38 of wedge ledge 36 engage the slot of the backboard along with the upper hooks 26, the tab portions 38 occupying the remaining vertical clearance in the slot between the inserted hooks 26 and the top edge of the slot. With the sliding tray in such a rearward position, the fixture is locked onto the backboard;

the hooks 26, 28 cannot be raised in the slots to permit fixture removal unless and until the tray base 30 is slid forward to disengage the wedge ledge tab portions 38 from the slots.

In order to retain the tray in the rearward position, an interlock between the tray base 30 and tray mounting bracket 20 may be provided. As perhaps best seen in FIGS. 2A, 2B and 4A, interlock 46 may comprise a lock arm 44 extending forwardly from the forward end of the mounting bracket 20. A pair of upwardly-directed locking hooks 48, each having a vertical rear face, are located on the lock arm. A pair of slots 50 are located in the floor 32 of the tray base 30 through which the hooks project, and include transverse wall portions 52 against which the hooks 48 bear to lock the tray in the rear position. The slots 50 also define the sides of a generally T-shaped arm 54, formed integral with the tray base floor 32. The T-shaped arm 54 terminates at the front of the tray base in a finger grip portion 56 which, when the tray base is in the rearward and locked position, may be flexed upward to slightly displace the floor 32 of the tray base upwardly from the mounting bracket 20 to allow the transverse wall portions 52 of the slots 50 to clear the interlock hooks 48 and disengage the interlock. The tray base 30 can then be slid forwardly to unlock the fixture from the backplate.

Figure 4A:
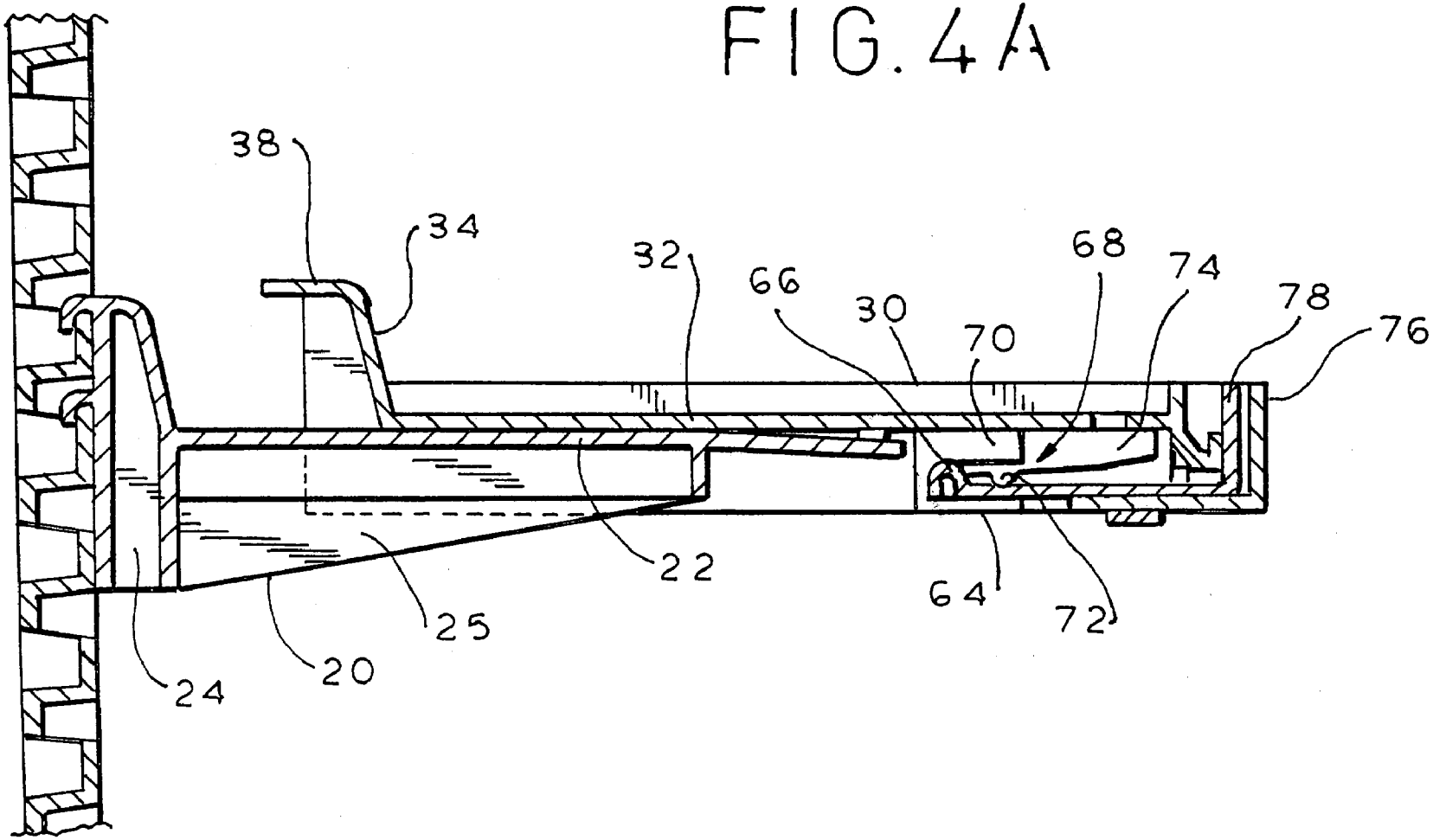
FIG. 4A is a sectional view taken along line 3—3 of FIG. 2A, showing the fixture with the tray base in the forward, unlocked position.
Figure 4B:
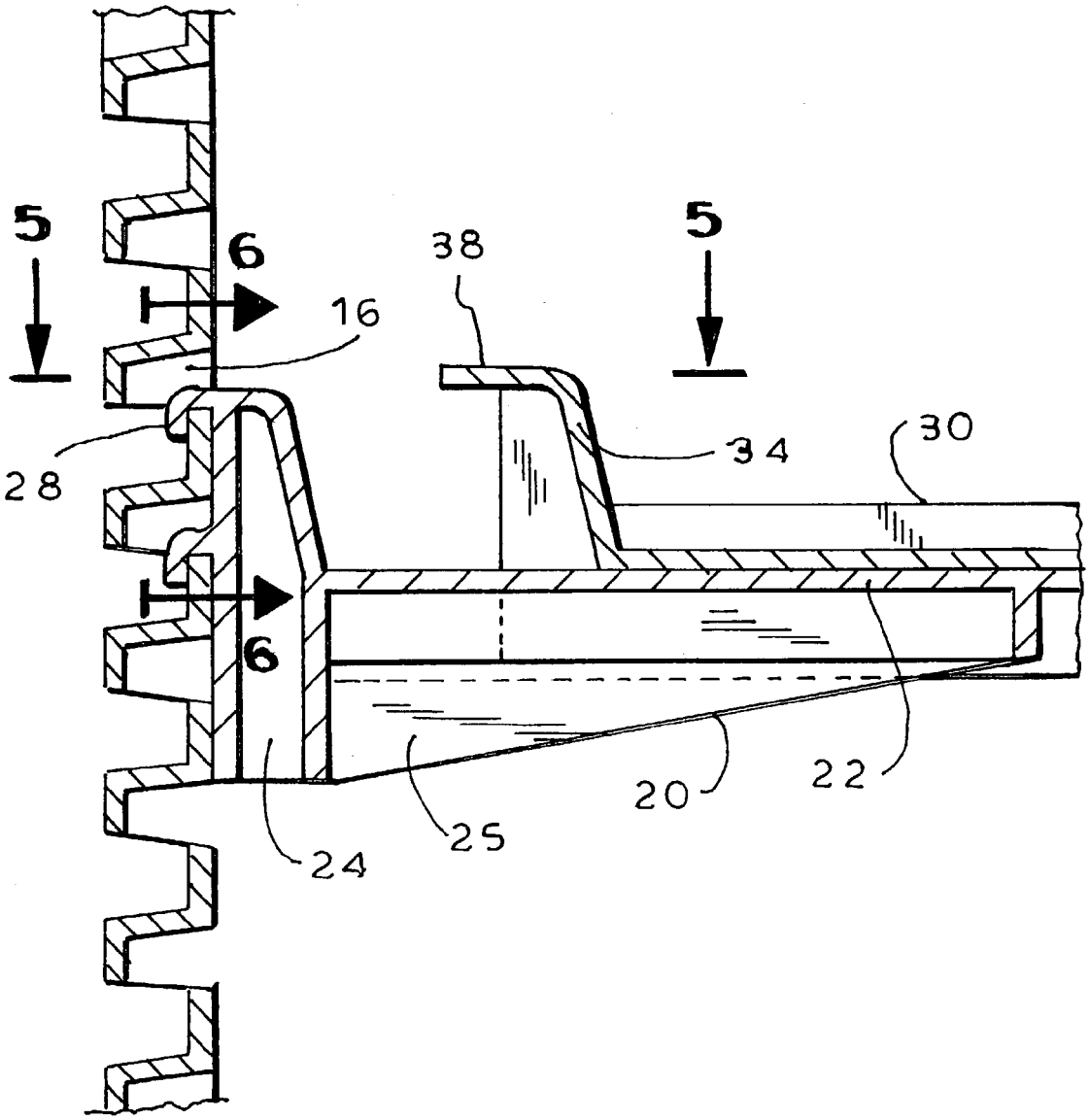
FIG. 4B is a detail view of the rear portion of the fixture as shown in FIG. 4A.
Figure 5:
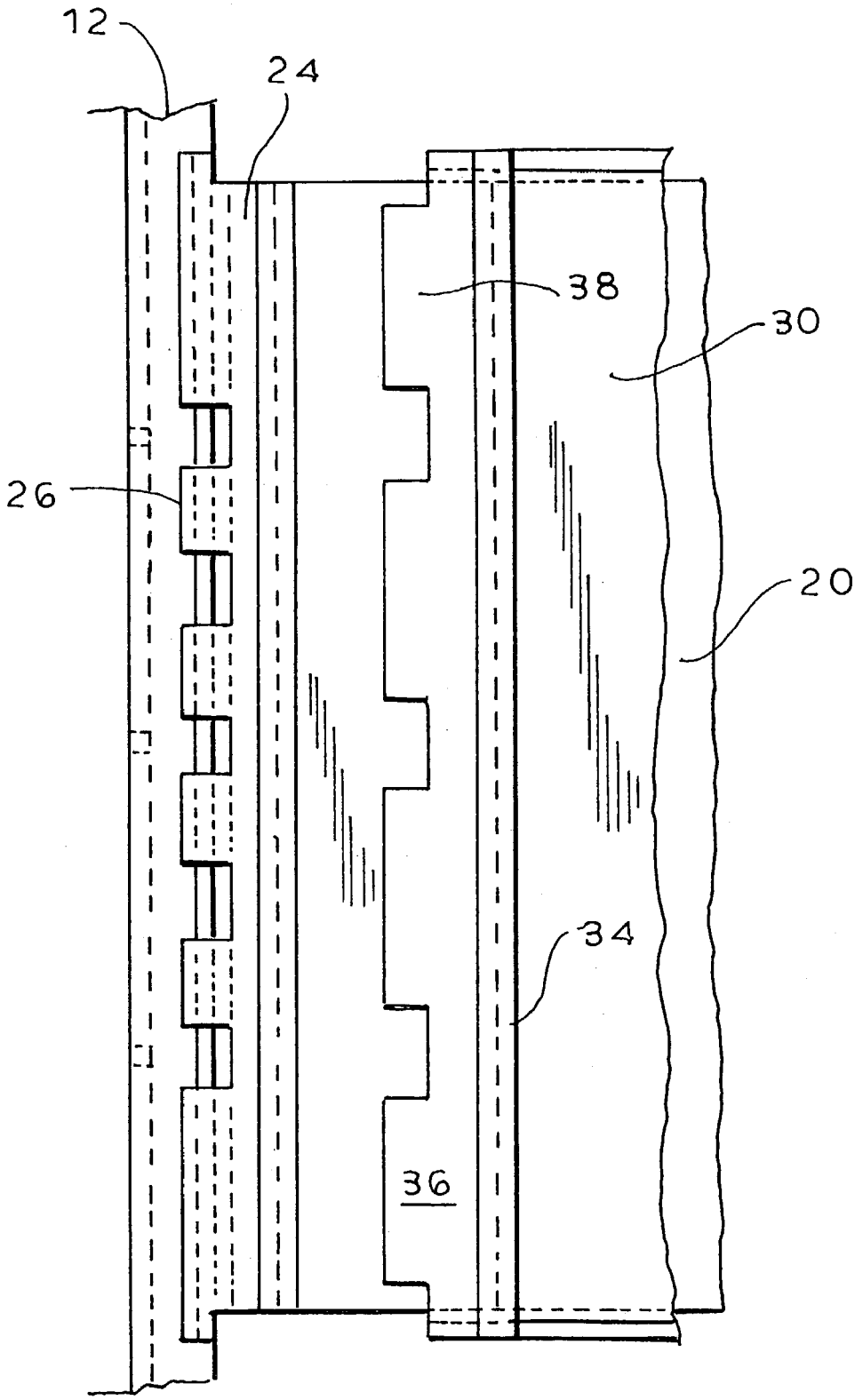
FIG. 5 is a top plan view of the fixture of FIG. 4A taken along line 5—5 of FIG. 4B.
Figure 6:
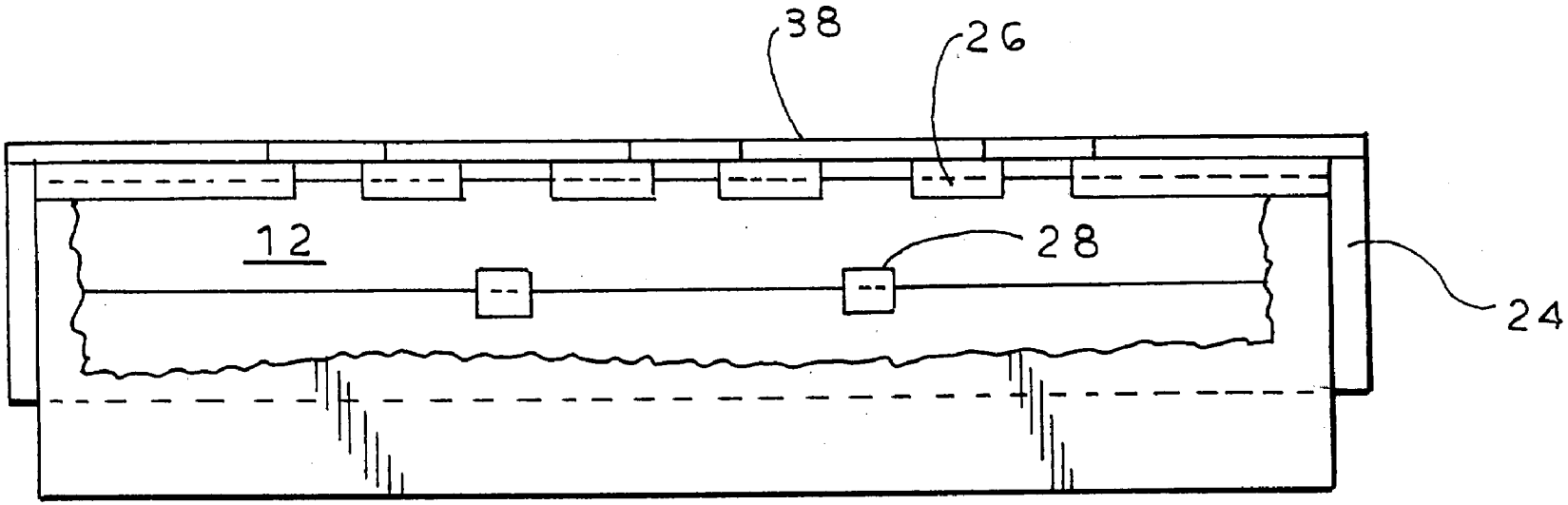
FIG. 6 is a rear end view of the fixture of FIG. 4A taken along line 6—6 of FIG. 4B.

Sliding tray base 30 may also be provided with a retractable depending price rail 58, seen in FIG. 2A in a depending position. The price rail includes a main wall 60 and a perpendicular lower front wall 62. In the position shown in FIG. 2A, the main wall 60 is exposed, and may serve as a mounting surface for detailed product indicia or stocking information. With the price rail in the retracted position, as shown in FIG. 4A, the front face of front wall 62 is vertical and exposed.

The side edges of the price rail main wall 60 are supported on a pair of side ledges 64 extending inwardly from the sidewalls 40 of the tray below floor 32, the front portions of the ledges being cut away to allow the price rail to depend from the ledges when it is slid forward. The rear edge of the price rail main wall 60 is formed into a transversely-extending hemispherical portion 66, which when the price rail is retracted, enters a pair of slots 68 formed between the bottom surface of tray floor 32 and locking flanges 70 depending therefrom. A pair of downwardly-extending protrusions 72 on the bottom surface of guide ribs 74 engage and pass the hemispherical portion 66 as the price rail is retracted and serve to further maintain the price rail in the retracted position.

The front wall 62 of the price rail is constructed with spaced front and rear wall elements 76, 78 which define a transverse acceptance slot 80 therebetween in which a descriptive product data card may be inserted. The front wall element 76 is transparent so that the card contents can be seen. It is to be noted that access to T-shaped arm 54 and finger grip portion 56 to unlock the fixture is afforded only when the price rail 58 is slid forward or is in the depending position.

An integral part of the present invention is the backboards 12, which provide a rigid yet light mounting medium for the fixtures 14. The backboards 12 may be affixed directly to a vertical surface, such as a wall, or may retrofitted to another type of backboard, such as a pegboard or slot or uni-wall, to convert a conventional fixturing system to the fixturing system of the present invention. In addition to allowing the fixtures of the present invention to be utilized, the backboards also provide an attractive foundation for the system, and are preferably of a modular-type construction that allows large expanses of wall to be covered by a plurality of interconnected backboard units.

With primary reference to FIGS. 1A–1F, 2A, 8 and 9, an individual backboard panel 12, which may be constructed of an appropriate plastic, is of a frame construction, with peripheral frame 82 supporting the spaced horizontal front wall slats 84 which create the fixture mounting slots 16 therebetween. A typical backboard panel may be approximately 12 inches wide by 24 inches high, with the slats 84 being about 0.6 inch high spaced to form 0.4 inch slots therebetween. The front wall slats 84 are formed as an integral part of horizontal runners 86, which include a front slat 84, intermediate horizontal rail 88, and a depending rear vertical slat 90, located forwardly of the rear edge of the side walls 92 of peripheral frame 82. A series of spaced vertical ribs or stiffeners 94 extend the height of the backboard and interconnect the runners 86, providing reinforcement therefor. The resulting construction provides a backboard capable of supporting a significant cantilevered fixture load without racking or twisting, while maintaining a light weight. Because the side walls 92 extend rearwardly a greater distance than the frame top and bottom walls 96, the backboard panel can more easily accommodate irregularities in the surface against which the panel is mounted. The horizontal rails 88 may be provided with spaced apertures "A", shown in phantom in FIG. 9, to accommodate peg hooks, thus providing additional flexibility of use, whereby conventional hangers may be utilized. Appropriate apertures or mounting bores may be provided to allow the backboard to be directly affixed to a wall surface. The backboards may preferable be mounted by use of brackets, as will be discussed, that allow mounting either to a wall or as a retrofit to and over a conventional fixturing wall surface, such as pegboard or slotwall.

The sidewalls 92 of the frame 82 are formed with raised areas 170 which, when adjacent backboards are aligned, align, forming a series of acceptance slots 172 running vertically therebetween (see FIG. 1A) for dividers and the like that can be inserted into the slots and locked about the rear edge of the raised area and which can be used to assist in the planogram of the backboard wall and divide the wall into product segment areas in accordance with known display techniques.

To allow the individual backboards to be interconnected, the top wall 96 of the frame includes a central flange 100 and a pair of peripheral slots 102, as seen in FIG. 1C, while the bottom wall 96 is provided with a mating central slot 104 and a pair of peripheral flanges 106 to engage the top slots 102. The flanges and slots interfit when backboard panels are vertically aligned to assist in maintaining register of the panels.

To interlock the sides of individual backboard panels, a first sidewall 92 of each of the backboard frames is provided with a series of integrally-molded snap-lock pins 108, while the opposite or second sidewall is provided with an aligned series of reception apertures 110. When engaged, the pins and apertures secure the backboards in a horizontally-extending array, and in conjunction with the slots and flanges on the top and bottom backboard walls, allow an extended unitary backboard construction to be formed. A guide flange 174 and a mating slot 176 may be provided on the sidewalls to assist in registration and interconnection of the panels.

Figure 10:
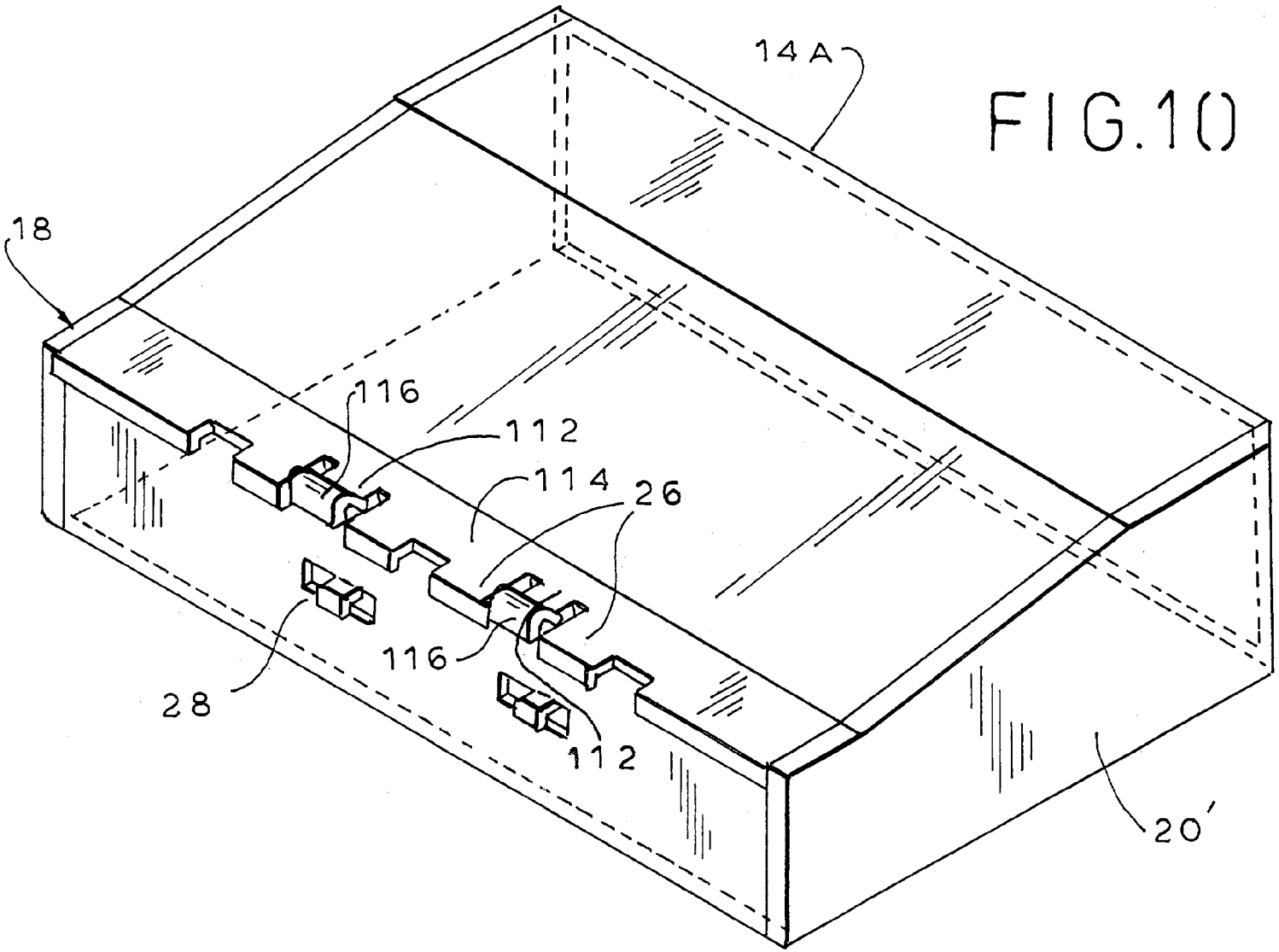
FIG. 10 is a perspective view of an alternative fixture construction.

FIG. 10 illustrates an alternative construction for a fixture 14A, in which mounting bracket 20' is depicted as comprising a frame or housing having an open front end to accommodate a drawer-like element (not shown) in lieu of a tray base 30. In this embodiment the engagement means 18 at the rear of the fixture again comprise lower mounting tabs 28 and upper mounting tabs 26. In lieu of a horizontal wedge ledge on a sliding tray base, a pair of resilient wedge members 112 are provided and extend rearward from a rear horizontal wall portion 114 of the mounting bracket, and are located between adjacent spaced pairs of upper mounting tabs 26, which are similarly formed as extensions to the rear horizontal wall. Each of the resilient wedge members 112 includes an upwardly-extending distal cam portion 116. The fixture unit 14A is mounted upon a backboard 12 by aligning the upper and lower mounting tabs 26, 28 with the appropriate slots 16. So oriented, the upper portion of cam portion 116 of the wedge member 112 extends slightly above the upper edge of the slot for the upper mounting tabs 26. A horizontal inserting mounting force engages the cam member against the upper edge, the flexibility of the wedge member allowing the cam member and wedge member to deflect downward, permitting the mounting bracket to be fully pushed back, against the backboard, and mounting tabs to fully enter the slots. The fixture 14A may then be dropped slightly, engaging the mounting tabs with the slot bottom walls. So installed, the cam portion 116 is within the slot for the upper mounting tab 26, the top of the cam being slightly below the top edge of the slot. Removal of the fixture from the backboard requires upward movement of the fixture, at which time the cam portion engages the upper edge of the slot before the tab clears the slot wall, and thus requires additional increased upward force to flex the wedge member and cams sufficiently for the mounting tabs to clear the slot walls. In such a manner, the locking wedges provide a locking function, preventing inadvertent removal of the fixture from the backboard.

Figure 11:
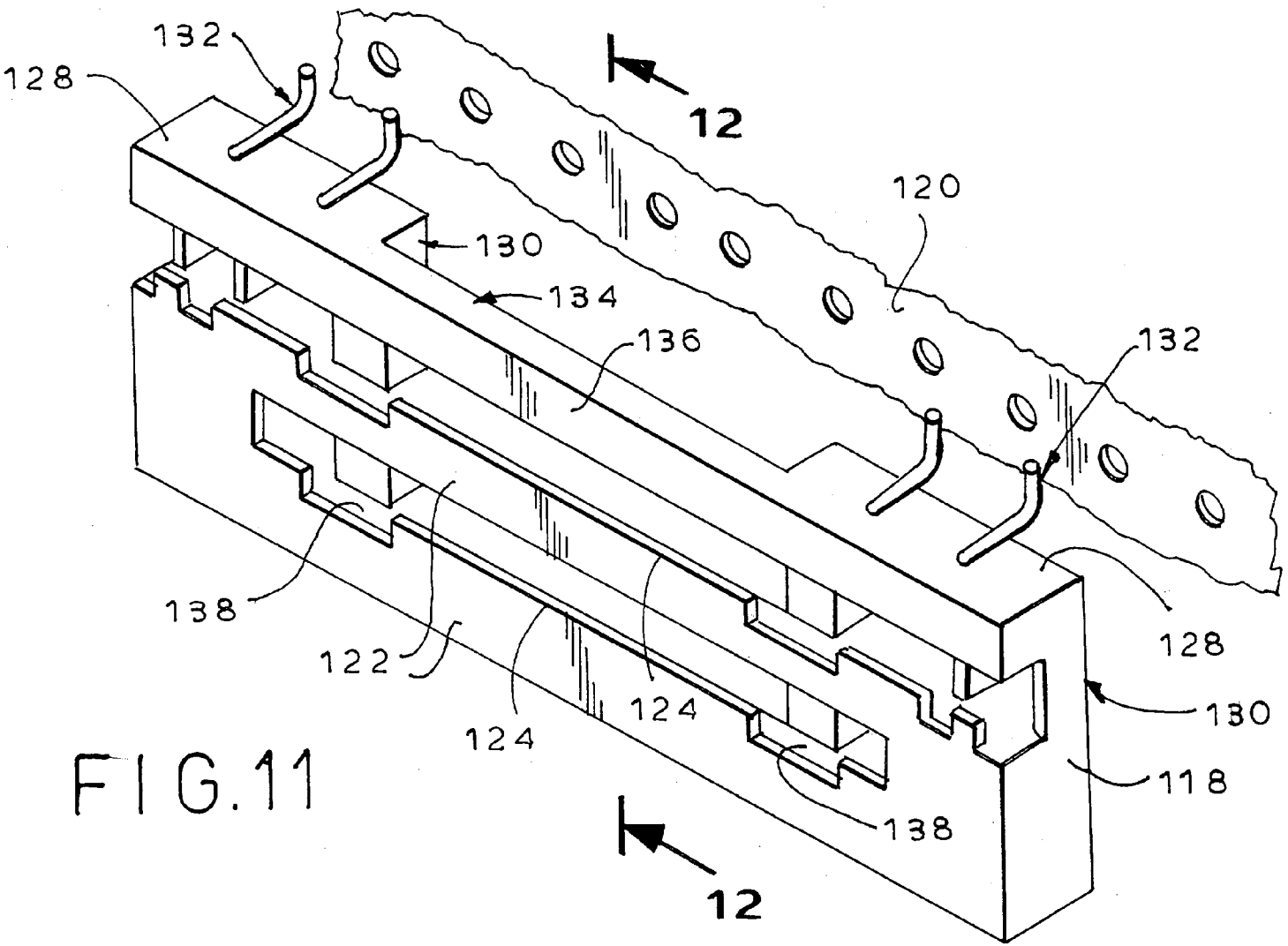
FIG. 11 is a perspective view of a first adapter bracket of the invention allowing a fixture to be mounted to a pegboard or slot wall.
Figure 12:
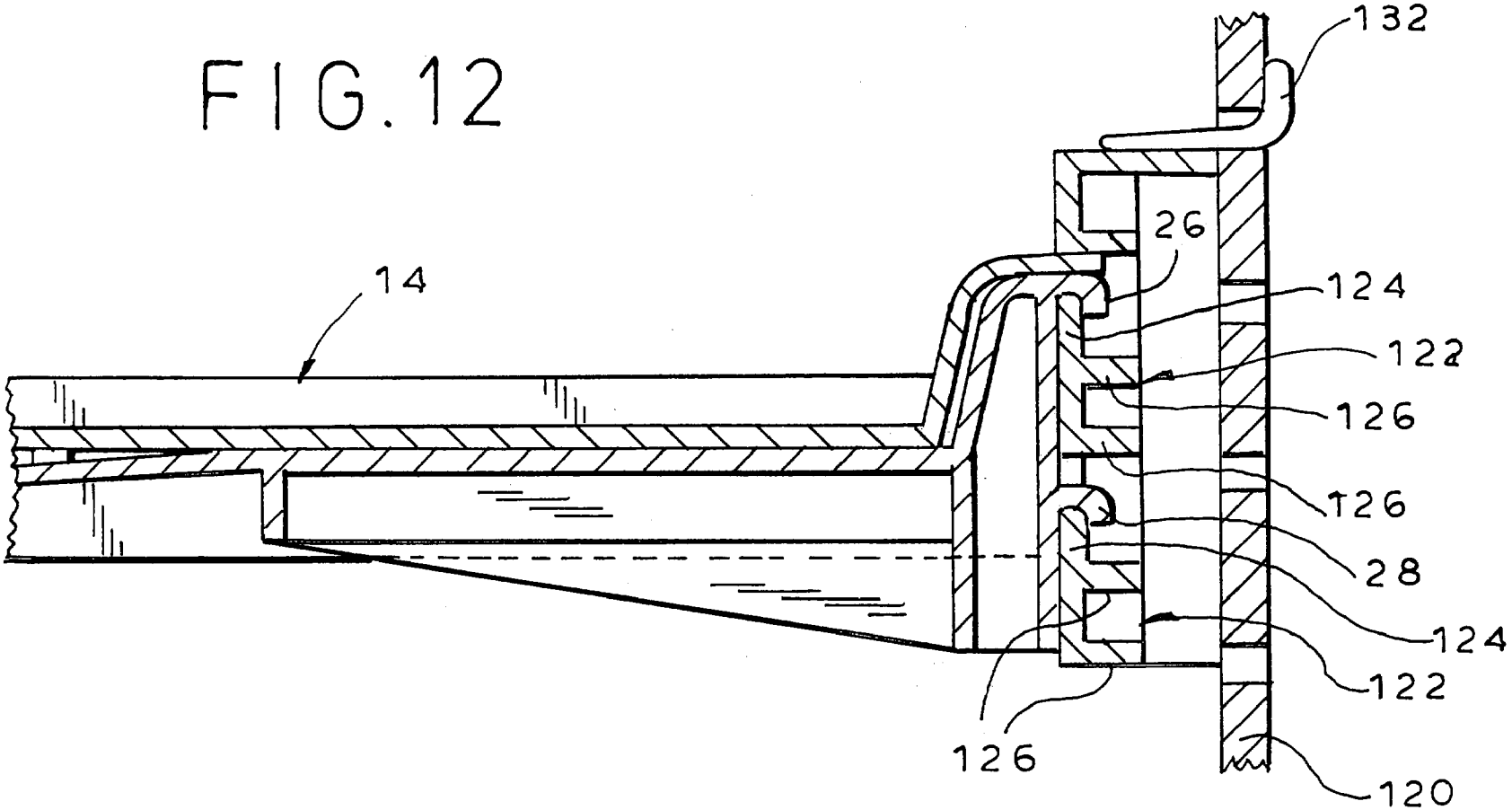
FIG. 12 is a section view depicting a fixture installed on the adapter bracket of FIG. 11 in turn installed on a pegboard.

FIGS. 11 and 12 illustrate an adapter 118 which can be used to allow a fixture 14 or 14A to be utilized in conjunction with conventional mounting wall surfaces, such as a pegboard 120. As depicted therein, adapter unit 118 includes a pair of spaced slats 122 which mimic the spacing of the slats on a backboard 12. The front wall portions 124 of the slats are reinforced by a pair of rearwardly-extending horizontal ribs 126 located below the top edge of the front wall 124 to allow upper and lower tabs 26, 28 of a fixture to engage the front wall. The slats 122 are supported at their ends by a pair of mounting block portions 128 which extend rearwardly of the slats. Each of the mounting block portions 128 have a rear surface 130 dimensioned and adapted to rest against pegboard wall 120. Pairs of mounting hooks 132 are provided on the blocks to engage the pegboard bores, whereby the adapter 118 is supported upon the pegboard with the rear surfaces 130 of the mounting block portions 128 flush against the pegboard. An upper stiffener slat 134 also extends between the mounting block portions and includes a lower horizontal wall 136 which provides the upper edge for the slot between the upper stiffener slat 134 and the adjacent slat 122. As may be appreciated, a fixture 14 is mounted upon the adapter in the same manner as it may be mounted upon a backboard 12, thereby allowing fixtures to be ultimately supported on the pegboard 120. Relieved portions 138 may be provided in a slat 122 in the area of the mounting block portions 128 for molding relief as the adapter may be molded as an integral unit of ABS or other appropriate material.

Figure 13:
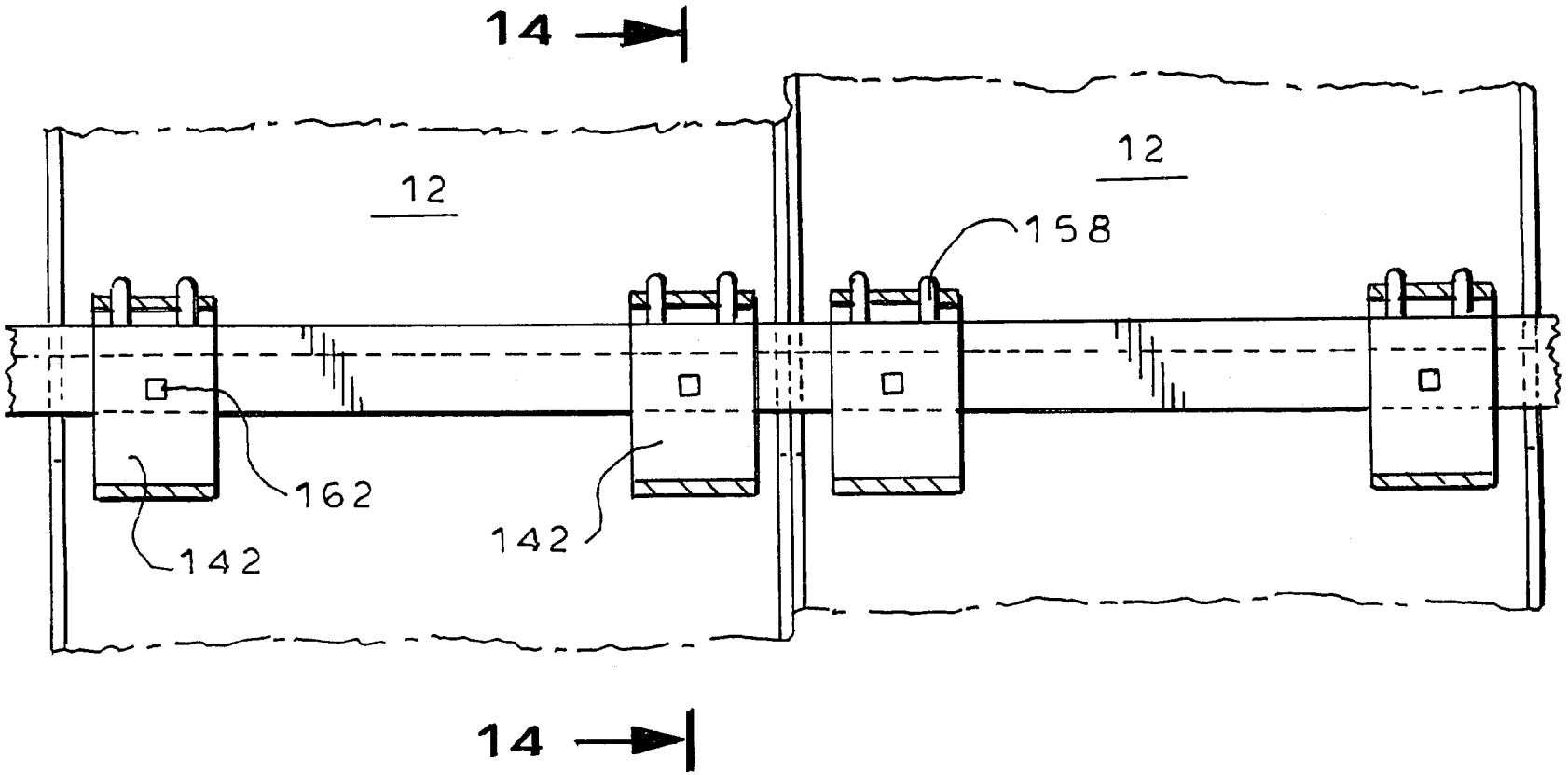
FIG. 13 is a rear elevation view taken along line 13—13 in FIG. 14 of a second adapter bracket system of the invention installing a backboard on a pegboard or slot wall.
Figure 14:
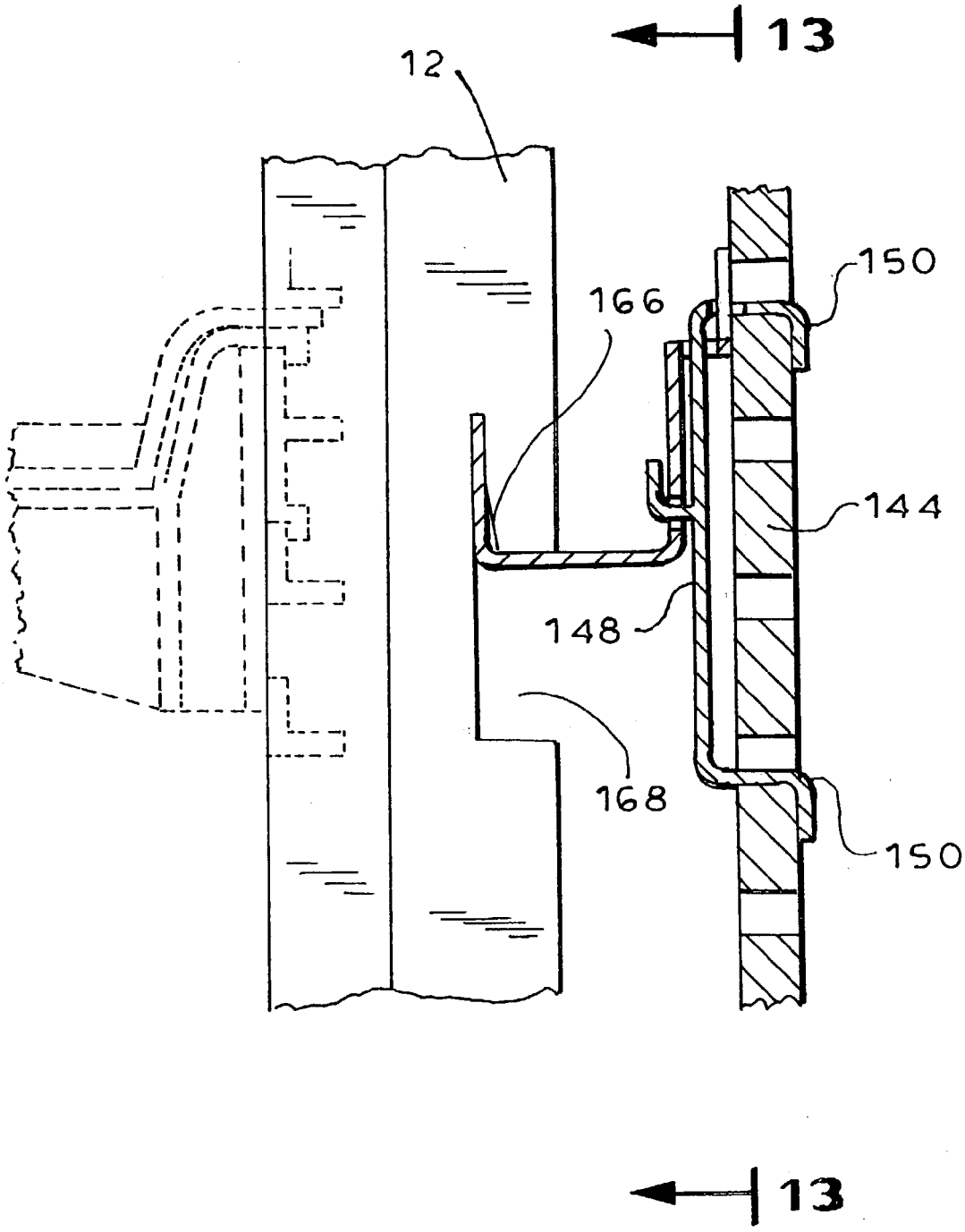
FIG. 14 is a section view taken along line 14—14 in FIG. 13 further depicting a backboard installed on a slotwall by use of the adapter bracket system.
Figure 15:
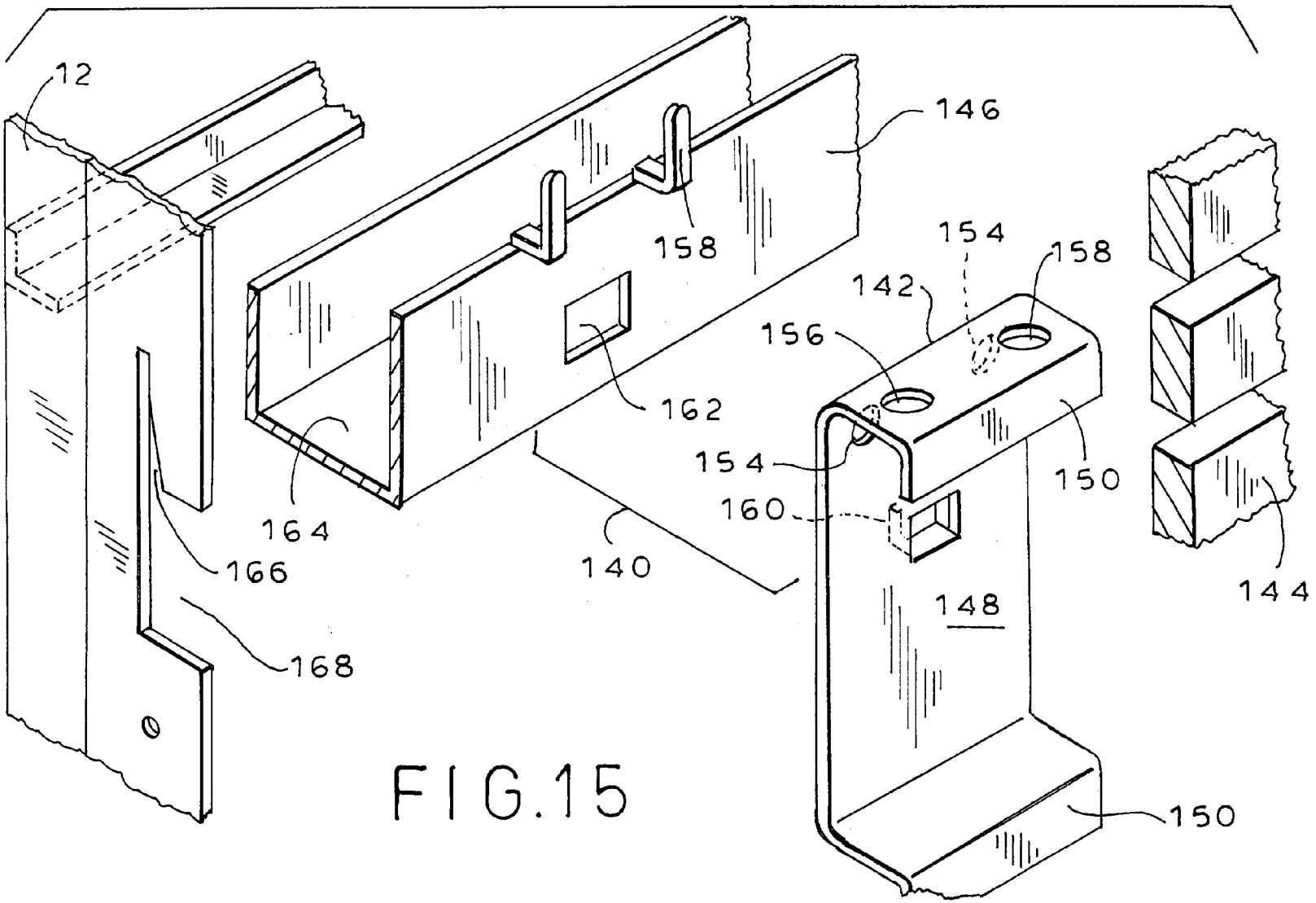
FIG. 15 is an exploded view of the second adapter bracket system.

FIGS. 13–15 depict a second adapter unit assembly which may be utilized to mount the backboards 12 upon a slot wall or pegboard system, thus allowing the present invention to be retrofitted upon conventional display walls. With initial reference to FIG. 15, the second adapter system 140 includes a first bracket 142 adapted to be mountable upon a slot wall 144, as well as a second bracket 146, adapted to be mounted upon a pegboard and also to support the backboards 12.

First bracket 142 comprises a front plate 148, from which upper and lower L-brackets 150 extend rearwardly. The upper and lower L-brackets 150, 152 are so spaced and dimensioned to allow them to be inserted into the slots of slot wall 144 and engage the slat members thereof to support the bracket thereon. The bracket 142, which may be formed of steel or other appropriate material, further includes a pair of spaced bores 154 on its front plate 148 and a second pair of bores 156, aligned therewith, on the upper bracket 150. Bores 154, 156 are so located and dimensioned to accept a pair of L shaped pins 158 extending rearwardly on second bracket 146, whereby the second bracket 146 may be mounted to, and supported by, first bracket 142. Similarly, the front plate 148 of first bracket 142 may be provided with a projecting hook 160 which is adapted and dimensioned to engage the top edge of aperture 162 on second bracket 146, thus locking the second bracket upon the first.

Second bracket 146 may be configured as an extended length of a generally U-shaped element 164, the rearwardly-directed vertical wall of which supports the L-pins 158, while the front wall of which is adapted to engage and support the backboard 12. In particular, and as can perhaps best be seen in FIGS. 14 and 15, the sidewalls 92 of the peripheral frame of a backboard panel 12 is provided with a series of upwardly-extending slots 166 adapted and dimensioned to receive the front wall of second bracket 146 with clearance apertures 168, located at the lower ends of the slots 166, provided in the sidewall to permit the backboard 12 to be raised and lowered with the bracket front wall aligned with the slots 166 for installation and removal purposes. As depicted in FIG. 13, a series of first brackets 142 are mounted in a horizontal line in a slot wall, the brackets supporting an extended length of second bracket 146, to which one or more backboards 12 may then be mounted. Preferably, a vertical series of first and second brackets are mounted to the slot wall, in alignment with the reception slots 166 on the backboards, to allow a full desired array of interconnected backboards to be assembled on the slot wall. It is to be appreciated that the access apertures 168 on the sidewalls of the backboard panels, in addition to facilitating mounting of the backboards on the brackets, also allow the brackets to accommodate irregularities in the slot wall, as well as permitting the interconnection of the panels. As the second brackets 146 may be of extended length, the backboards mounted thereon can be horizontally positioned as desired thereon. Without the pins 158, brackets 146, installed directly upon a wall, may also allow a backboard array to be directly wall-mounted.

Preferably, the spacing of the mounting pins 158 on second brackets 146 duplicate the horizontal spacing of the apertures on conventional pegboards. Thus, the second brackets 146 may be mounted directly to a pegboard surface, allowing the backboards 12 to be mounted thereon in an analogous manner to their mounting in connection with slot wall constructions. The second bracket system 146 thus allows extreme flexibility of mounting of the backboards, accommodating both slot wall and pegboard-type environments.

I claim:

1. A mounting panel for the removable mounting of display fixtures, comprising at least two horizontal runners extending across a width of the panel defining a slot therebetween for the acceptance of a fixture, a runner comprising a vertical front slat, an intermediate horizontal rail, and a vertical rear slat; a peripheral frame having side walls between which the horizontal runners extend and top and bottom walls, the side walls including mounting bracket acceptance means for mounting the panel upon a slotwall or backing board: and a series of spaced ribs running between the top and bottom walls and engaging the horizontal runners.

2. The mounting panel of claim 1 wherein the front and rear slats are vertically offset from each other.

3. The mounting panel of claim 2 wherein a front slat is joined to a corresponding rear slat by a horizontal rail.

4. The mounting panel of claim 1 wherein the horizontal rails have spaced apertures to accommodate peghooks.

5. The mounting panel of claim 1 wherein the horizontal runners are mounted at opposite ends to a pair of mounting blocks.

6. A mounting panel for the removable mounting of display fixtures, comprising at least two horizontal runners extending across a width of the panel defining a slot therebetween for the acceptance of a fixture, a runner comprising a vertical front slat, an intermediate horizontal rail, and a vertical rear slat; a pair of mounting blocks located at opposite ends of the horizontal runners; and a horizontal member extending between the mounting blocks above the horizontal runners defining a slot between the horizontal member and an uppermost horizontal runner.

7. The mounting panel of claim 6 wherein the mounting blocks have means for mounting the panel to a slotwall or backing board.

8. A mounting panel for the removable mounting of display fixtures, comprising at least two horizontal runners extending across a width of the panel defining a slot therebetween for the acceptance of a fixture, a runner comprising a vertical front slat, an intermediate horizontal rail, and a vertical rear slat; and a peripheral frame having side walls between which the horizontal runners extend and top and bottom walls, the top and bottom walls including means for interconnecting vertically adjacent mounting panels.

9. The mounting panel of claim 8 wherein the interconnecting means comprise tabs and mating reception slots.

10. The mounting panel of claim 8 wherein the interconnecting means comprise a tab between a pair of reception slots on one of the top or bottom wall and a reception slot between a pair of tabs on the other of the top or bottom wall.

11. The mounting panel of claim 8 further comprising a series of spaced ribs running between the top and bottom walls and engaging the horizontal runners.

12. The mounting panel of claim 8 wherein the front and rear slats are vertically offset from each other.

13. The mounting panel of claim 8 wherein the side walls include mounting bracket acceptance means for mounting the panel upon a slotwall or backing board.

* * * * *